United States Patent [19]

Beatty et al.

[11] 3,960,087

[45] June 1, 1976

[54] SMOKE AND ILLUMINATION SIGNAL

[75] Inventors: Bobby D. Beatty, Bloomfield; Russell D. Daniel, Bloomington; Billy J. Humerickhouse, Odon; Gary G. Norris, Burns City, all of Ind.

[73] Assignee: The United States of America as represented by the Secretary of the Navy, Washington, D.C.

[22] Filed: Oct. 4, 1974

[21] Appl. No.: 512,262

[52] U.S. Cl. ..... 102/90; 102/6; 102/37.7; 102/66; 149/18; 149/19.91; 149/84; 149/85; 149/116

[51] Int. Cl.[2] ..... F42B 13/44

[58] Field of Search ..... 102/6, 7, 14, 16, 32, 102/37.7, 37.8, 81, 70 R, 87, 90, 6, 66; 149/84, 85, 116, 18, 117, 19.91

[56] References Cited

UNITED STATES PATENTS

| | | | |
|---|---|---|---|
| 2,423,859 | 7/1947 | Van Karner | 102/37.8 X |
| 2,545,275 | 3/1951 | Griffith | 102/37.7 |
| 2,595,757 | 5/1952 | Brandt | 102/78 |
| 2,628,897 | 2/1953 | Vinton | 102/37.8 |
| 3,196,789 | 7/1965 | Fasig et al. | 102/7 |
| 3,199,453 | 8/1965 | Fasig et al. | 102/7 |
| 3,338,763 | 8/1967 | Kristal et al. | 149/85 |
| 3,634,152 | 1/1972 | Yanagesawa | 149/84 |
| 3,722,407 | 3/1973 | Fogal et al. | 102/81 |
| 3,766,858 | 10/1973 | Handler et al. | 102/7 |

*Primary Examiner*—Harold Tudor
*Attorney, Agent, or Firm*—R. S. Sciascia; Paul S. Collignon

[57] ABSTRACT

A pyrotechnic signal providing smoke and flame and which is launchable from underwater. Launching of the signal from underwater arms the signal, however, the signal is not initiated until the ambient sea pressure reaches a predetermined pressure valve. When this predetermined pressure valve is reached, sea water enters a cavity and energizes a battery which detonates an electric squib. The squib, in turn, ignites a smoke composition in the signal housing.

8 Claims, 4 Drawing Figures

SMOKE AND ILLUMINATION SIGNAL

BACKGROUND OF THE INVENTION

The present invention relates to a signaling device and more particularly to a signaling device which is launchable from underwater and which rises to the surface and produces smoke and flame. One particular use of the present invention is that of launching the signal from underwater to simulate that a mine has been detonated.

Various types of signaling devices have been launched underwater to indicate the position of a vessel, such as a submarine, a swimmer, or of a mine. Generally, these signaling devices have some type of delay mechanism so that ignition of the pyrotechnic material is delayed until the signal floats to the surface. One type of ignition system being successfully used by the Navy employs a sea water battery which, when activated, provides a voltage which will ignite or explode squibs to ignite a pyrotechnic composition. The sea water battery is not energized until the signal nears the surface and thus ignition is delayed. One such signaling device is shown in U.S. Pat. 3,196,789 entitled, "Submarine Signal Fuze", which issued July 27, 1965, to Stanley M. Fasig and Glenn C. Johnson. In this signaling device, the fuze is armed when a lever strikes the end of a launching tube and is pivoted thereby unlocking a valve assembly. This valve assembly is held closed by water pressure until the signal nears the surface whereupon a spring opens the valve and ejects a battery into the sea.

SUMMARY OF THE INVENTION

The present invention relates to a pyrotechnic signal which can be launched underwater, as from a float. Ejection of the signal from the float causes an arming cup to be rotated and then ejected. When the signal nears the surface, a cavity is opened and flooded thereby energizing a sea water battery which provides current for detonating a squib. The squib, in turn, ignites a smoke composition and the burning of this pyrotechnic material increases pressure within the signal to eject a plug thereby permitting smoke to flow through an opening in the signal shell.

It is therefore a general object of the present invention to provide a smoke and illumination signal which can be launched underwater and which will be ignited when the signal nears the surface.

Other objects and advantages of the present invention will be readily appreciated as the same becomes better understood by reference to the following detailed description when considered in connection with the accompanying drawings.

DESCRIPTION OF THE PREFERRED EMBODIMENT

Figure 1:
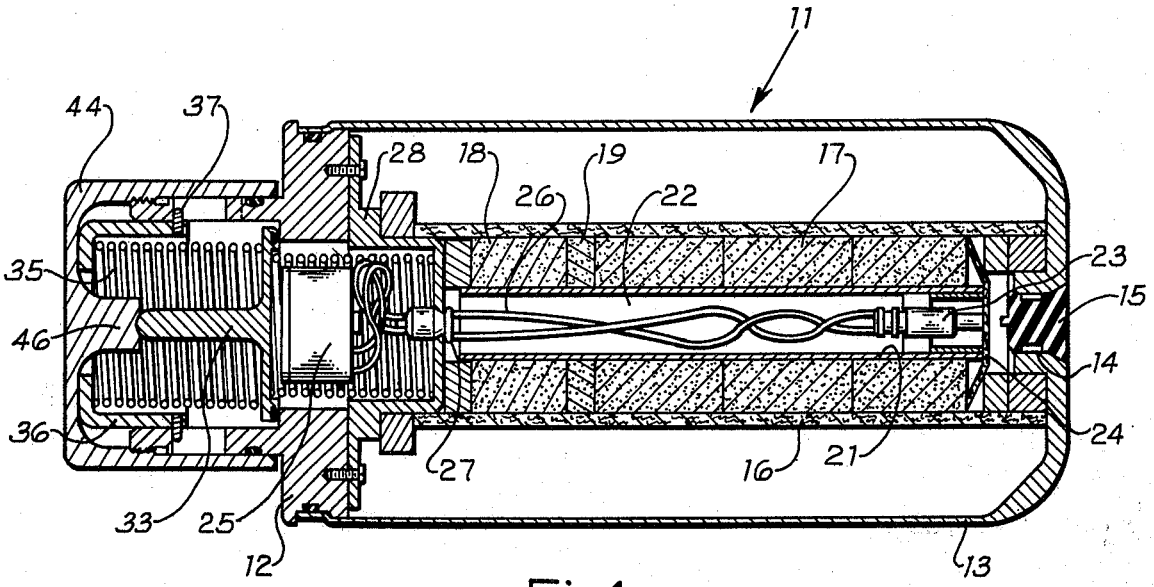
FIG. 1 is a longitudinal sectional view of a preferred embodiment of the present invention.
Figure 2:
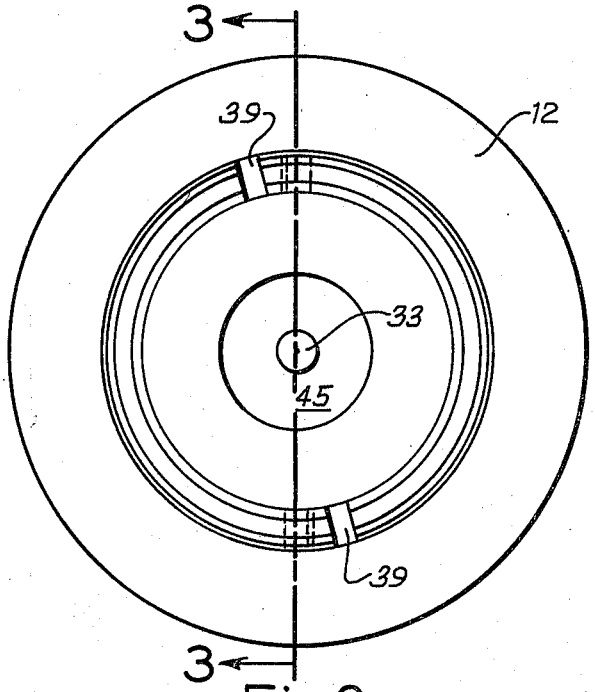
FIG. 2 is an end view of a base assembly.

Referring now to the drawings, there is shown a smoke and illumination signal 11 having a base 12 to which a shell 13 is attached. Shell 13 is provided with an orifice 14 which is closed by a plug 15. A combustion tube 16, which is made of fish paper or other combustible material, is attached to base 12 and contains a smoke composition 17 and a flare composition 18. A starter composition 19 is provided between the two pyrotechnic compositions so that, at the end of the burning time for smoke composition 17, starter composition 19 is ignited and, in turn, ignites flare composition 18. In one embodiment of the invention used by the Navy, a green colored smoke flare composition is used and, in another embodiment, a yellow colored smoke and flare composition is used.

The green colored smoke composition consists, by weight, of between 45 and 51 parts of a green dye mix, between 22 and 28 parts of potassium chlorate, between 17 and 23 parts of refined sugar, between two and four parts of baking soda and between 3 and 5 parts of diatomaceous earth. The green dye mix is comprised, by weight, of 75 percent of solvent green 3 dye, 10 percent of benzanthrone dye and 15 percent of vat yellow 4 dye.

The green flare composition consists, by weight, of between 13.28 and 17.28 parts of magnesium powder, between 18.92 and 24.92 parts of potassium perchlorate, between 43.55 and 49.55 parts of barium nitrate, between 10.00 and 16.00 parts of polyvinyl chloride and between 2.25 and 4.25 parts of a binder solution. A binder solution suitable for use might consist of 98.5 percent of Laminac 4110 procured from American Cyanamide Company and 1.5 percent of a catalyst solution which is a 60% solution of methyl ethyl ketone peroxide in dimethylphthalate, procured as Lupersol DDM from the Lucidol Div. of Wallace and Tierman, Inc.

The yellow colored smoke composition consists, by weight, of between 50 and 54 percent of yellow dye mix, between 19 and 25 percent of potassium chlorate, between 10 and 16 percent of refined sugar, between 2 and 8 percent of baking soda and between 5 and 11 percent of diatomaceous earth. The yellow dye mix is comprised, by weight, of 42 percent of vat yellow 4 dye and 58 percent of benzanthrone dye.

The yellow flare composition consists, by weight, of between 17 and 21 percent of magnesium powder, between 12 and 22 percent of potassium perchlorate, between 24 and 34 percent of barium nitrate, between 23 and 31 percent of sodium oxalate, between 3 and 5 percent of asphaltum, and between 3-3/4 and 4-1/4 percent of a binder solution. A binder solution suitable for use might consist of 98.5 percent of Laminac 4110 procured from American Cyanamide Company and 1.5 percent of a catalyst solution which is a 60% solution of methyl ethyl ketone peroxide in dimethylphthalate, procured as Lupersol DDM from the Lucidol Div. of Wallace and Tierman, Inc.

Starter composition 19 is comprised, by weight, of between 79.80 and 80.20 percent of tetra-red lead oxide, between 15.90 and 16.10 percent of silicon and between 3.96 and 4.04 percent of a binder solution, which is 79 percent vinylidene fluoride and 21 percent hexafluoropropylene.

A small diameter tube 21 of fish paper or other combustible material is provided within the pyrotechnic materials and provides a passageway 22. An electric squib 23 is positioned within passageway 22 adjacent the end of smoke composition 17 and an ignition heat pad 24 of paper is provided at the end of smoke composition 17. Upon detonation of squib 23, pad 24 is ignited and, in turn, ignites smoke composition 17. A sea water battery 25 is provided in base 12 and is electrically connected to squib 23 by leads 26 which pass through passageway 22. As shown in FIG. 1 of the drawings, leads 26 pass through a grommet 27 which is provided in a base cover 28, so that, when sea water energizes battery 25, water cannot enter to extinguish the burning pyrotechnic materials.

Figure 3:
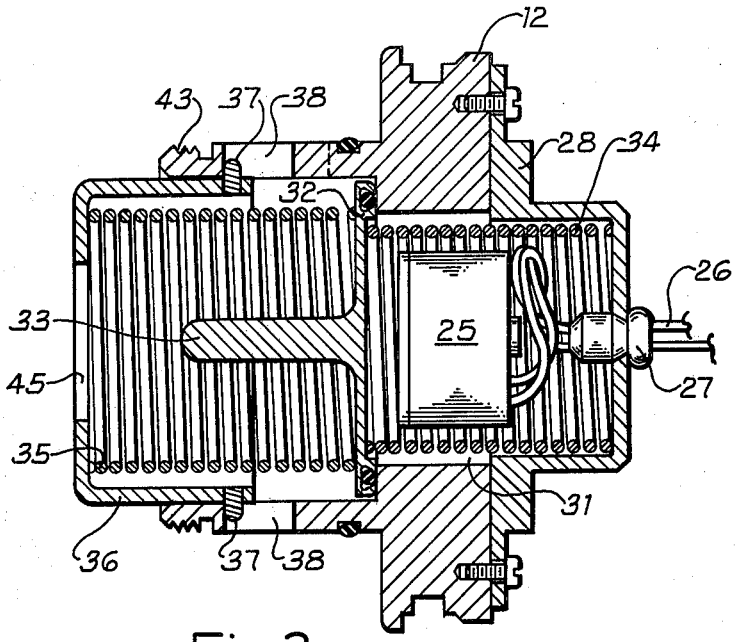
FIG. 3 is a sectional view taken on line 3-3 of FIG. 2.
Figure 4:
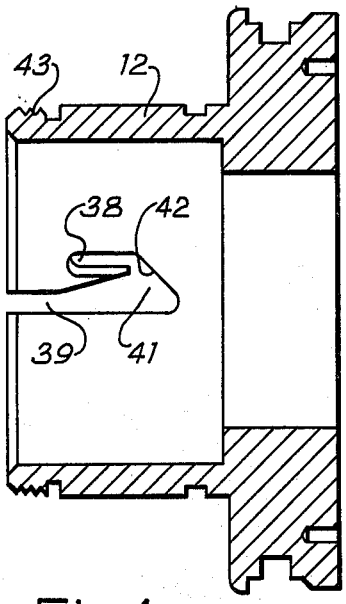
FIG. 4 is a sectional view of a base.

Referring now to FIG. 3 of the drawings, it can be seen that battery 25 is positioned in a cavity 31 in base 12 and that cavity 31 has one end closed by base cover 28. The other opening of cavity 31 is closed by disc 32 which has an elongated probe 33 extending outwardly. A first compression spring 34 is provided in cavity 31 between base cover 28 and the inner side of disc 32 and spring 34 provides a biasing force to move disc 32 outwardly. A second compression spring 35 is positioned between the outer side of disc 32 and an arming cup 36 to provide a biasing force that keeps disc 32 in a position for closing cavity 31. Arming cup 36 is provided with a pair of guiding pins 37 that engage slots in base 12. As best shown in FIG. 4 of the drawings, the slots in base 12 consist of a short slot 38 and a longer slot 39 that extends to the end of base 12. The metal between slots 38 and 39 is removed so that the slots are connected by a passageway 41 and the inner-most edge of passageway 41 is provided with a tapered surface 42. When pins 37 are positioned in slots 38, arming cup 36 is secured to base 12. When arming cup 36 moves inwardly, guiding pins 37 will engage surface 42 and pins 37 will be shifted from short slot 38 to longer slot 39, and the biasing force applied by compression spring 35 will disengage arming cup 36 from base 12.

The outer end of base 12 is provided with threads 43 and a protective cap 44 is threadedly attachable thereto. Arming cup 36 is provided with a hole 45 and a boss 46 on the inside of protective cap 44 passes through hole 45 and engages probe 33 on disc 32. Protective cap 44 thus locks disc 32 so that cavity 31 remains securely sealed during storage. Protective cap 44 is removed prior to signal 11 being used.

OPERATION

Prior to operation, protective cap 44 is removed from signal 11 which is then attached to some type of launching device. For example, in one use by the Navy, signal 11 is attached to a float which is anchored under water at a depth up to 160 feet. Signal 11 is separated from the anchored float by an explosive device, and the force of the explosion causes arming cup 36 to move toward disc 32 thereby compressing spring 35. Guiding pins 37 on arming cup 36 move in short slot 38 and, upon contacting tapered surface 42, arming cup 36 is rotated and pins 37 are aligned in long slot 39. Compression spring 35 then moves arming cup 36 outwardly and arming cup 36 and spring 35 separate from base 12. After spring 35 separates from base 12, water pressure holds disc 32 against base 12 and keeps cavity 31 closed. As signal 12 rises to the surface, the water pressure against disc 32 decreases and when the force applied by spring 34 exceeds ambient water pressure, spring 34 ejects disc 32 and sea water enters cavity 31. Sea water energizes battery 25 and current from battery 25 detonates electric squib 23, which ignites heat pad 24. Heat pad 24, in turn, ignites smoke composition 17. The combustion of smoke composition 17 increases the pressure within shell 13 and this pressure ejects plug 15 from shell 13 thereby permitting smoke to flow through orifice 14. When smoke composition 17 is nearly consumed, starter composition 19 is ignited from the burning smoke composition and starter composition ignites flare composition 18.

It can thus be seen that the present invention provides an improved smoke and flare signaling device which can be launched from underwater. Obviously many modifications and variations of the present invention are possible in the light of the above teachings. It is therefore to be understood that within the scope of the appended claims the invention may be practiced otherwise than as specifically describe.

We claim:

1. A smoke and illumination signal adapted to be launched in a body of sea water beneath the surface thereof comprising, a base having a cavity therein, a sea water battery positioned within said cavity, a disc closing an opened end of said cavity, a shell attached to one end of said base containing a smoke composition and a flare composition separated by a quantity of a starter composition, said smoke composition being comprised, by weight, of between 50 and 54 percent of yellow dye mix, between 19 and 25 percent of potassium chlorate, between 10 and 16 percent of refined sugar, between 2 and 8 percent of baking soda and between 5 and 11 percent of diatomaceous earth and said flare composition being comprised by weight of between 17 and 21 percent of magnesium powder, between 12 and 22 percent of potassium perchlorate, between 24 and 34 percent of barium nitrate, between 23 and 31 percent of sodium oxalate, between 3 and 5 percent of asphaltum and between 3¾ and 4¼ percent of binder material, an electric squib adjacent said smoke composition and electrically connected to said sea water battery, an arming cup slidably and removably attached to said base, a first compression spring in said arming cup biasing said disc in a closing relationship with respect to said cavity, and a second compression spring within said cavity biasing said disc in an opening relationship with respect to said cavity whereby, upon launching of said signal, said first compression spring ejects said arming cup and said second compression spring ejects said disc.

2. A smoke and illumination signal as set forth in claim 1 wherein said base is provided with a threaded portion and a protective cap is threadedly connected with said threaded portion and engages said disc to lock said disc prior to said signal being placed in use.

3. A smoke and illumination signal as set forth in claim 1 wherein said base is provided with at least one closed end slot and at least one opened end slot, said slots being connected by a passageway having a tapered surface and wherein said arming cup is provided with at least one guiding pin engageable in said slots.

4. A smoke and illumination signal as set forth in claim 1 wherein said shell is provided with an orifice in one end and having a plug closing said orifice whereby said plug is ejected upon buring of said pyrotechnic composition.

5. A smoke and illumination signal adapted to be launched in a body of sea water beneath the surface thereof comprising, a base having a cavity therein, a sea water battery positioned within said cavity, a disc closing an opened end of said cavity, a shell attached to one end of said base containing a smoke composition and a flare composition separated by a quantity of a starter composition, said smoke composition being comprised, by weight, of between 45 and 51 percent of green dye mix, between 22 and 28 percent of potassium chlorate, between 17 and 23 percent of refined sugar, between 2 and 4 percent of baking soda and between 3 and 5 percent of diatomaceous earth, and said flare composition being comprised, by weight, of between 13.28 and 17.28 percent of magnesium powder, between 18.92 and 24.92 percent of potassium perchlorate, between 43.55 and 49.55 percent of barium nitrate, between 10.00 and 16.00 percent of polyvinyl chloride and between 2.25 and 4.25 percent of binder material, an electric squib adjacent said smoke composition and electrically connected to said sea water battery, an arming cup slidably and removably attached to said base, a first compression spring in said arming cup biasing said disc in a closing relationship with respect to said cavity, and a second compression spring within said cavity biasing said disc in an opening relationship with respect to said cavity whereby, upon launching of said signal, said first compression spring ejects said arming cup and said second compression spring ejects said disc.

6. A smoke and illumination signal as set forth in claim 5 wherein said base is provided with a threaded portion and a protective cap is threadedly connected with said threaded portion and engages said disc to lock said disc prior to said signal being placed in use.

7. A smoke and illumination signal as set forth in claim 5 wherein said base is provided with at least one closed end slot and at least one opened end slot, said slots being connected by a passageway having a tapered surface and wherein said arming cup is provided with at least one guiding pin engageable in said slots.

8. A smoke and illumination signal as set forth in claim 5 wherein said shell is provided with an orifice in one end and having a plug closing said orifice whereby said plug is ejected upon burning of said pyrotechnic composition.

* * * * *